United States Patent [19]

Elbert

[11] 4,013,461

[45] Mar. 22, 1977

[54] HIGH VOID POROUS SHEET AND PROCESS THEREFOR

[75] Inventor: Raymond John Elbert, Middleburg Heights, Ohio

[73] Assignee: Union Carbide Corporation, New York, N.Y.

[22] Filed: May 8, 1975

[21] Appl. No.: 575,734

Related U.S. Application Data

[63] Continuation-in-part of Ser. No. 164,516, July 21, 1971.

[52] U.S. Cl. ..... 75/212; 29/182; 75/200; 75/211; 75/221; 75/222

[51] Int. Cl.[2] ..... B22F 3/18

[58] Field of Search ..... 75/223, 221, 211, 200, 75/226, 212, 201, 222; 29/423, 182; 264/.5

[56] References Cited

UNITED STATES PATENTS

| | | | |
|---|---|---|---|
| 2,792,302 | 5/1957 | Mott | 75/222 X |
| 2,806,509 | 9/1957 | Bozzaco | 29/182.5 UX |
| 3,052,967 | 9/1962 | Fischer | 75/222 X |
| 3,135,044 | 6/1964 | Mote, Jr. et al. | 29/423 R |
| 3,214,270 | 10/1965 | Valyi | 75/222 X |
| 3,264,073 | 8/1966 | Schmitt | 75/208 R |
| 3,342,563 | 9/1967 | Butts | 75/222 X |
| 3,433,632 | 3/1969 | Elbert et al. | 75/222 |
| 3,504,884 | 11/1970 | Horbury | 75/222 X |
| 3,528,809 | 9/1970 | Farnand et al. | 75/222 |
| 3,535,110 | 10/1970 | Todd | 75/222 X |

OTHER PUBLICATIONS

Goetzel, C. G. Treatise on Powder Metallurgy, vol. 1, pp. 561–570., Interscience, N. Y., 1949.

*Primary Examiner*—Richard E. Schafer
*Attorney, Agent, or Firm*—J. Hart Evans

[57] ABSTRACT

A method of making a high void porous sheet by sintering metallic coated hollow carbonaceous particles and sheets made by such method.

9 Claims, 3 Drawing Figures

MAGNIFICATION-100 X

SINTERED POROUS NICKEL SHEET

MAGNIFICATION-100 X

SINTERED POROUS NICKEL SHEET

MAGNIFICATION-100 X

LIQUID PHASE SINTERED POROUS NICKEL SHEET

HIGH VOID POROUS SHEET AND PROCESS THEREFOR

RELATED APPLICATIONS

Figure 1:
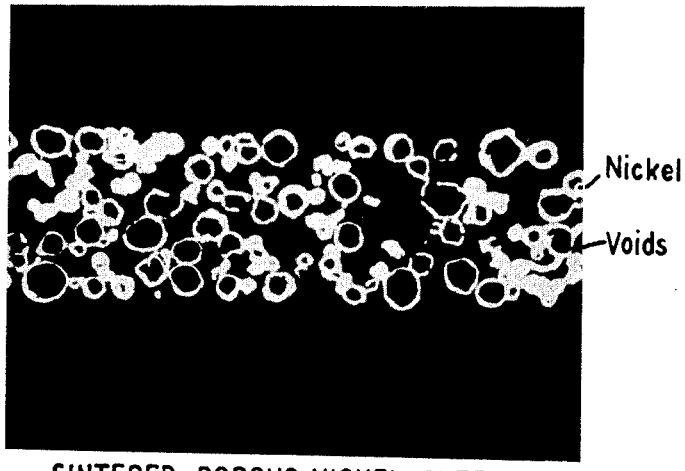

This application is a continuation-in-part of my copending application Ser. No. 164,516, filed July 21, 1971 entitled "High Void Porous Sheet and Process Therefor."

FIELD OF THE INVENTION

This invention relates to a high-void sheet and process therefor, fabricated from metallic plated carbonaceous spheres such as nickel plated carbon spheres.

DESCRIPTION OF PRIOR ART

There are many methods presently being utilized for forming porous bodies using powder metallurgic techniques. Generally, powder metallurgical processes involve the steps of shaping metal powder into green compacts by such techniques as loose packing, compaction, extrusion, rolling or the like and then consolidating the green composite so formed by the mechanism of sintering. Many of these processes are described in "Treatise on Powder Metallurgy" by C. G. Goetzel, Interscience Publishers, Inc., New York, New York 1949, and "Fundamental Principles of Powder Metallurgy," by W. D. Jones, Edward Arnold, publisher, London, England 1960.

The formation of sintered porous metal structures by the utilization of carbonaceous fillers adapted to determine the porosity of the structure and to be burnt out during sintering is known. The use of such fillers is somewhat limited, however, since they tend to contaminate the resulting structure with residue due to the products of combustion that are not removed. In addition, porosity in such metal structures is limited generally to less than fifty percent and is controlled mainly by compacting pressure techniques.

A recent modification of the conventional sintering technique entails the use of spherical powders to form porous bodies whereby the choice of particle size determines the pore diameter of interconnecting channels. However, a drawback to this technique is a restriction on pore size to approximately 5 microns due to the fact that the surface tension forces causing pore closure are inversely proportional to the diameter of the pore. Thus the stability of the open channels decreases sharply with pores of diameters smaller than about 5 microns due to the inherent closing of the channels during sintering.

The pore size of a generally uniform packing of spherical particles is usually about ⅓ the size of the sphere. This pore size is obtained by taking the perimeter of the pore formed by touching spheres and dividing by the area. Although large pores can be obtained by using large spheres, the sintering of large spheres together is difficult and doesn't lend itself for commercial production. The specific packing techniques; i.e. hexagonal packing, cubical packing, etc., are also a function of the end pore size in a powdered sintered sheet but the method for controlling the specific packing for producing a given porosity is difficult, if not impossible, to implement in commercial production runs.

The primary purpose of this invention is to overcome the foregoing drawbacks by utilizing metallic plated carbonaceous spheres to produce a high void, large pored, porous sheet since not only will the metal mass be considerably distended in a uniform fashion but also sintering will be enhanced by virtue of the added surface energy associated with the thin sections that will make up the metallic matrix of the sheet.

SUMMARY OF INVENTION

Broadly stated, the invention relates to a process for producing a high void, porous sheet from metallic coated hollow carbonaceous spheres. The porous sheet, so produced, is admirably suited for use in such applications as filters, abradable seals, sound suppression structures, energy absorbing materials, NiCd battery plates, electrodes, ionizers and the like.

Hollow carbonaceous spheres such as carbon, graphite, and the like can be fabricated by conventional techniques such as disclosed in U.S. Pat. Nos. 2,797,201, 2,978,339 and 3,264,073. The diameter of the spheres can vary somewhat depending on the desired porosity of the sheet. Generally, however, a sphere diameter of between about 0.001 inch and about 0.010 inch is desirable for most applications. The diameter of spheres according to our invention should not be greater than 0.030 inch. The wall thickness of the carbonaceous spheres can vary somewhat depending on the properties of the porous sheet desired, i.e., whether the carbonaceous material is to be completely removed or not. The wall thickness also relates to the size of the pores desired in the final sheet since once the diameter of the hollow sphere is selected, the thickness of its wall will determine the size of the hollow cavity therein. It is this hollow cavity that contributes significantly to the porosity of the sheet fabricated from the spheres. Generally a wall thickness between about 0.001 inch and about 0.001 inch is adequate for most applications.

A metallic material capable of coalescence at an elevated temperature and being non-reactant with a selected carbonaceous sphere at such temperature is then deposited on the carbonaceous sphere. A coated layer of between about 0.0001 inch and about 0.001 inch is suitable for most applications although thicker layers can be used. When it is desired to have at least some of the metallic coated spheres break thereby producing a fiber type porous structure, then the thickness of the metallic layer has to be appropriately selected. Any metallic material capable of being deposited on carbonaceous spheres by any conventional technique such as flame spraying, painting, electroplating, electroless plating and the like can be used. Materials such as nickel, tungsten, copper and aluminum in any and all proportions are but a few of the materials admirably suited for this purpose. The metallic coated hollow carbonaceous spheres can then be processed into sheet stock by any conventional powder metallurgical technique such as that described in U.S. Pat. No. 3,433,632. The sintering temperature employed in fabricating the sheet stock is usually higher than normally employed so as to intensify and insure bond formation between the metallic coatings on the spheres. During this sintering step, the carbonaceous material is substantially burnt out.

The random distribution of the metallic coated spheres during sintering will produce additional pores in the final sheet since coalescence will occur generally between tangentially touching surfaces leaving the space between non-touching spheres void, thereby adding to the overall porosity of the material. By proper selection of the spherical sizes, a porous sheet can be fabricated having a porosity of at least 50% and as high as 90%.

Figure 2:
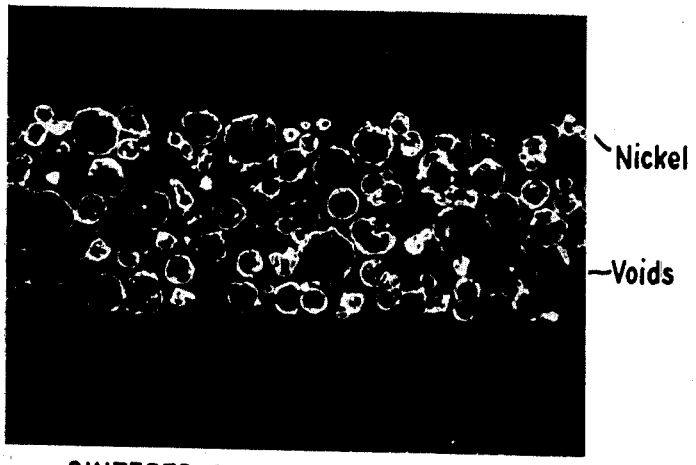
Figure 3:
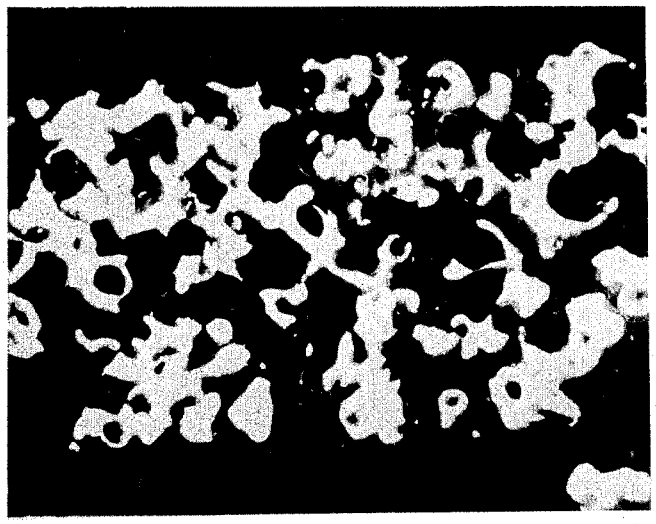

FIGS. 1 through 3 show various magnified cross-sections of porous sheets prepared according to this invention.

A preferred embodiment of this invention consists of employing between about 0.002 inch and about 0.004 inch diameter hollow carbon spheres having a wall thickness between about 0.0001 inch and about 0.0002 inch. The spheres are substantially plated with between about 0.0002 inch and about 0.0004 inch layer of a metal such as nickel using a $NH_3$-leach-$H_2$ reduction process known as the Sherritt-Gordon process. This process is described in an article titled "The Preparation of Nickel-Coated Powders" by B. Meddings, W. Kunda and V. N. Mackew, POWDER METALLURGY, Interscience Publishers, Inc., 1961, pages 775 – 798. The coated spherical particles are then formed into a sheet by use of a plastic mix or by loose powder packing and sintered at an elevated temperature, depending on the metallic coating selected, for a time period sufficient to cause diffusion bonding to occur between the metallic layers. When using nickel, a temperature above about 1100° C. is suitable.

In a preferred embodiment of the invention the sintered sheet with its diffusion bonded spheres is subjected to a liquid phase sintering which is achieved at a lower temperature by the use of a melting point depressant. The melting point depressant additive forms a eutectic alloy with the outer surface of the sphere coating, thereby allowing a partial liquid phase to occur at a lower temperature thus, the action of the alloy-forming melting point depressant material is in direct contrast to the action of brazing materials which themselves melt and adhere with no alloying.

The melting point depressant technique is particularly useful with spheres of nickel, copper, tungsten and aluminum. Suitable depressant materials are those which readily form eutectic alloys with the particular metal of the spheres being used. For nickel spheres these are phosphorus, boron, magnesium and manganese while for copper the more suitable are silicon, phosphorous, magnesium and calcium. For tungsten spheres materials of iron or carbon are suitable while for those of aluminum calcium or silicon materials are useful. While elemental powders can be used they involve the physical problem of introducing a dispersion into a partially sintered structure and getting the reactant material to the point where the bond exists.

Compounds of these elements are more readily employed therefor. Thus phosphorous, in addition to the elemental form, may be used as an acid such as phorphoric acid or phosphorous acid, or as a bromide or iodide of phosphorous. A preferred melting point depressant for nickel and copper spheres is phosphoric acid, $H_3PO_4$. Boron is best used in the elemental state while magnesium can be used as the acetate or chlorate. Manganese is suitably added as the chloride bromide or oxalate. Silicon will readily permeate and alloy if used as gaseous silane but can also be applied as the bromide, iodide or chlorohydride. Calcium can be used as the bromide, chloride or iodide. Carbon can be used in the elemental form or can be added as a hydrocarbon, such as methane, which will readily permeate the structure and then deposit carbon when it contacts the heated porous metal substrate. Iron is suitably added in the elemental form or as the chloride. With all such elements and compounds the objective is to get the element into intimate contact with the sphere surface so that it can alloy and form a eutectic with it.

The hollow particles for use in this invention need not be perfectly spherical but may be elliptically shaped or have random type projections. In addition, the overall spherical size of the particles used in fabricating a porous sheet may vary in size and/or shape.

The following examples will serve to illustrate the high void, porous sheets obtainable using this invention.

EXAMPLE 1

Phenolic plastic hollow spheres having an average diameter of about 0.003 inch and thickness of 0.0001 inch were commercially obtained from Union Carbide Corporation who prepared them in accordance with U.S. Pat. No. 2,797,201. The spheres were then carbonized by heating them to 900° C. in a nitrogen atmosphere. The resulting carbon spheres were plated with an average 0.0003 inch layer of nickel by Sherritt-Gordon Mines Limited using its Sherritt-Gordon $NH_3$-leach-$H_2$ reduction process. This process is described in the above-identified publication.

The nickel plated hollow spheres were formed into a green sheet by being case on a plastic sheet by the techniques expressed in U.S. Pat. No. 3,433,632, Example 3. The green sheet was then heated to 1100° C. for 20 minutes at −20° C. dew point $H_2$ to coalesce the nickel. The sintered porous sheet measuring 5 inches × 10 inches by 0.017 inch thick was tested and found to have a void friction of 85% and an average pore size of about 150 microns. A magnified cross-section of the sheet is shown in FIG. 1 wherein the pores of the hollow spheres and the pores between adjacent sintered nickel plated spheres are clearly shown.

EXAMPLE 2

Phenolic plastic hollow spheres as in Example I were carbonized by heating them to 900° C. in a nitrogen atmosphere. The resulting carbon spheres were plated with an average of 0.0003 inch layer of nickel using the Sherritt-Gordon $NH_3$-leach-$H_2$ reduction process and then formed into a green sheet as described in Example I. The green sheet was then heated to 1200° C. for 10 minutes at −20° C. dew point $H_2$ to coalesce the nickel. The sintered porous sheet measuring 5 inches wide × 10 inches long × 0.013 inch thick was tested and found to have a void friction of 77% and an average pore size of 70 microns. A magnified cross-section of the sheet is shown in FIG. 2 wherein the pores of the hollow spheres and the pores between adjacent sintered nickel plated spheres are clearly shown.

EXAMPLE 3

Phenolic plastic hollow spheres as in Example I were carbonized by heating them to 900° C. in a nitrogen atmosphere. The resulting carbon spheres were plated with an average 0.0003 inch layer of nickel using the Sherritt-Gordon $NH_3$-leach-$H_2$ reduction process as in Example I. The nickel plated hollow spheres were loose-packed as a 1/32 inch layer on a graphite plate and then heated to 100° C. for 20 minutes at −20° C. dew point $H_2$ to coalesce the nickel. The sintered porous sheet was then dipped in a 5% solution of $H_3PO_4$, dried and reheated at 1100° C. for 20 minutes at −20° C. dew point to liquid-phase sinter the particles. This sheet measuring 5 inches × 10 inches × 0.014 inch thick was tested and found to have a void friction of 77% and an average pore size of 72 microns. A magnified cross-section of the sheet is shown in FIG. 3 wherein the effect of liquid phase sintering is clearly shown.

What is claimed is:

1. A process for fabricating high void, porous sheets comprising the following steps:

a. preparing hollow carbonaceous particles having a diameter no greater than 0.030 inch;

b. depositing a metallic layer on said particles, said metallic layer being non-reactant with said particles at the sintering temperature of the metallic material;

c. preparing a green sheet consisting of said metallic coated hollow particles;

d. heating said green sheet above the sintering temperature of said metallic material so as to bond said material thereby producing a high void, porous sheet;

e. depositing a melting point depressant on said sintered porous sheet; and f. heating said coated sintered sheet to a temperature sufficient to cause liquid phase sintering.

2. The process of claim 1 wherein said metallic material is selected from at least one of the elements nickel, copper, tungsten and aluminum.

3. The process of claim 1 wherein said metallic material is selected from at least one of the elements of nickel, copper, tungsten and aluminum.

4. The process of claim 3 wherein said melting point depressant is phosphoric acid.

5. A high void, porous sheet made by the process of claim 1.

6. The process of claim 1 wherein said hollow particles in step (a) measure between about 0.001 inch and about 0.010 inch in diameter and between about 0.0001 inch and about 0.001 inch in thickness and wherein the thickness of said metallic layer is between about 0.0001 inch and about 0.001 inch.

7. The process of claim 6 wherein said hollow particles are carbon, said metallic layer is nickel and said temperature in step (d) is above about 1100° C.

8. The process of claim 6 wherein the temperature in step (d) is below about 1450° C. so as to cause liquid phase sintering.

9. The process of claim 8 wherein said melting point depressant is phosphoric acid.

* * * * *

UNITED STATES PATENT OFFICE

CERTIFICATE OF CORRECTION

Patent No. 4,013,461 Dated March 22, 1977

Inventor(s) Raymond John Elbert

It is certified that error appears in the above-identified patent and that said Letters Patent are hereby corrected as shown below:

Column 2, line 34;"0.001 inch and about 0.001 inch"
should read --0.0001 inch and about
0.001 inch --

Signed and Sealed this
Twenty-fourth Day of May 1977

[SEAL]

*Attest:*

RUTH C. MASON
*Attesting Officer*

C. MARSHALL DANN
*Commissioner of Patents and Trademarks*